United States Patent [19]

Joss et al.

[11] 4,013,856

[45] Mar. 22, 1977

[54] PUSH BUTTON ASSEMBLY

[75] Inventors: Roger V. Joss, Clinton; William Semonchik, Normal; Arthur H. Unwin, Bloomington, all of Ill.

[73] Assignee: General Electric Company, New York, N.Y.

[22] Filed: Oct. 2, 1975

[21] Appl. No.: 619,088

[52] U.S. Cl. ..... 200/314; 200/159 R; 200/161

[51] Int. Cl.[2] ..... H01H 9/20

[58] Field of Search ..... 200/314, 161, 318–340, 200/159 R

[56] References Cited

UNITED STATES PATENTS

| | | | |
|---|---|---|---|
| 3,170,057 | 2/1965 | Kane et al. | 200/314 |
| 3,551,614 | 12/1970 | Babler | 200/159 R |

*Primary Examiner*—Robert K. Schaefer
*Assistant Examiner*—Morris Ginsburg
*Attorney, Agent, or Firm*—Stephen A. Young; Walter C. Bernkopf; Robert C. Cahill

[57] ABSTRACT

A push button assembly including an operating unit and a switch unit having an enclosure. The operating unit is comprised of a housing, fastened to the switch unit enclosure, and having a hollow interior section. The operating unit is further comprised of a collar member having one end positioned within the interior section of the housing and another end extending outward therefrom, and a mushroom head fixed to the other end of the collar member. Also provided is an actuating plunger having one end mechanically coupled to the one end of the collar member and having another end coupled to the switch unit. Further provided are means for maintaining the collar member in a first position and means for maintaining the collar member in a second position. The first position maintaining means is comprised of means for biasing the collar member in the direction outward from the interior of the housing, a projection having an upper and lower wall extending from an exterior surface of the collar member and joining at an apex distal from the exterior surface, and the interior section of the housing having a portion in juxtaposition with the upper wall of the projection to limit the outward movement of the collar member. The second position maintaining means is comprised of a washer member, a rigid spring seat, and a spring member biased toward the exterior surface of the collar member and positioned between the planes formed by the respective flat surfaces of the washer member and the spring seat, whereby the collar member is maintained in the second position when the spring member is squeezed between the upper wall of the projection and the flat surface of the washer member.

7 Claims, 4 Drawing Figures

PUSH BUTTON ASSEMBLY

BACKGROUND OF THE INVENTION

1. Field Of The Invention

This invention relates to push button assemblies, and more particularly, to push button assemblies which can be maintained in either of a first or a second position.

2. Description Of The Prior Art

In prior art push button assemblies having first and second maintained positions, it has been difficult to obtain adequate performance such that minimum force could be used to push a collar member from its first maintained position to its second maintained position, while ensuring that a greater degree of force would be necessary to pull the collar member from its second maintained position back to is first maintained position.

OBJECTS OF THE INVENTION

It is therefore an object of this invention to provide an improved push pull type push button assembly having a first and a second maintained position.

It is another object of this invention to provide a push button assembly which can be moved from its first maintained position to its second maintained position using minimum force.

It is still another object of this invention to provide a push button assembly which can be pulled from its second maintained position back to is first maintained position using a greater degree of force than is necessary in pushing the collar member from its first maintained position to its second maintained position.

Other objects of the invention will be pointed out hereinafter.

SUMMARY OF THE INVENTION

According to a broad aspect of the invention there is provided an improved push button assembly including an operating unit and a switch unit having an enclosure. The operating unit is comprised of a housing, fastened to the switch unit enclosure, and having a hollow interior section. The operating unit is further comprised of a collar member having one end positioned within the interior section of the housing and another end extending outward therefrom, a mushroom head fixed to the other end of the collar member, and an actuating plunger having one end mechanically coupled to the one end of the collar member and having another end coupled to the switch unit. Also provided are means for maintaining the collar member in a first position and means for maintaining the collar member in a second position. The first position maintaining means is comprised of means for biasing the collar member in a direction outward from the interior of the housing, a projection having an upper and lower wall extending from an exterior surface of the collar member and joining at an apex distal from the exterior surface, and a tapered portion of the interior section of the housing being in juxtaposition with the upper wall of the projection to limit the outward movement of the collar member, whereby when the upper wall of the projection is pressed against the tapered portion of the interior of the housing, the collar member is maintained in the first position. The second position maintaining means is comprised of a washer member, a rigid spring seat, and a spring member biased toward the exterior surface of the collar member and positioned between the planes formed by the respective flat surfaces of the washer member and spring seat, whereby the collar member is maintained in the second position when the spring member is squeezed between the upper wall of the projection and the flat surface of the washer member.

According to a feature of the invention, the plane of the lower wall of the projection is approximately perpendicular to the plane of the surface of the spring seat, and the plane of the flat surface of the washer is at approximately an acute angle with the plane of the surface of the spring seat, whereby when the mushroom head is depressed to move the collar member in a direction from the first position toward the second position, the lower wall of the projection ultimately contacts the spring member and forces the spring member to expand outward along the surface of the spring seat until the apex of the projection contacts the spring member, whereupon further continued movement of the collar member enables the spring member to contract and contact the upper wall of the projection and the surface of the washer member to retain the collar member in the second position. When the mushroom head is gripped and pulled to move the collar member from the second position toward the first position, the spring member is forced by the upper wall of the projection to expand outward in a direction parallel to the flat surface of the washer member and perpendicular to movement of the collar member until the apex contacts the spring member, whereupon further continued movement of the collar member allows the biasing means to return the collar member to the first position, thereby ensuring that a greater force is required to move the collar member from the second position to the first position than is required to move the collar member from the first position to the second position.

DESCRIPTION OF THE PREFERRED EMBODIMENT

Figure 1:
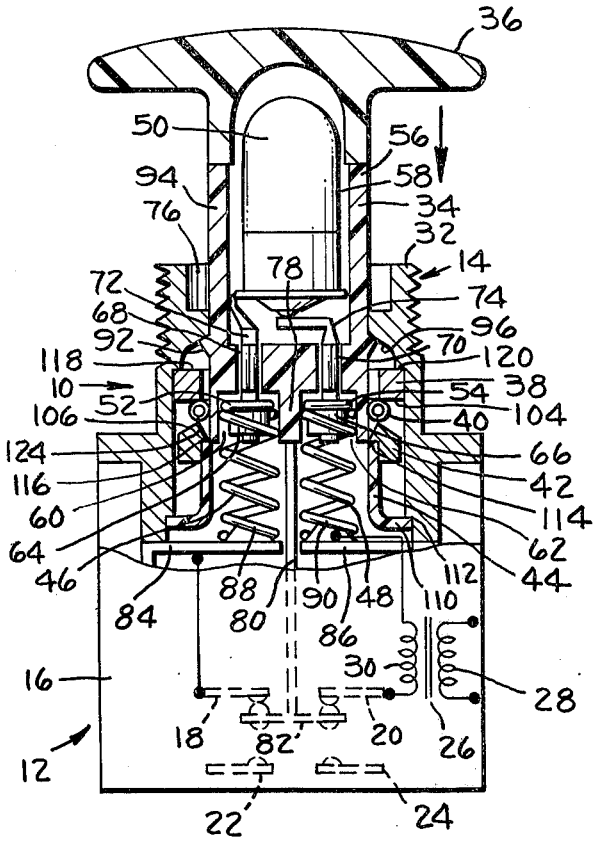
FIG. 1 is a sectional view of the push button assembly in accordance with the invention, when the collar member is in the first maintained position.

Referring to FIGS. 1 through 4, the invention will now be explained. As shown in FIG. 1, a push button assembly 10 is comprised of a switch unit 12 and an operating unit 14. Switch unit 12 can be a standard switch unit of the type which is part of the CR 104E Industrial Miniature Oil-Tight Push Button manufactured by the General Purpose Control Department of the General Electric Company, Bloomington, Illinois. The above identified type of switch unit generally comprises a molded plastic enclosure 16, a normally closed contact comprised of a pair of contact members 18 and 20, a normally open contact comprised of a pair of contact members 22 and 24, and a transformer 26 comprised of a primary winding 28 and a secondary winding 30, all of which are suitably positioned within enclosure 16. The switch unit also provides external terminals connected to primary winding 28 of transformer 26, and to respective contact members 18 and 20 of the normally closed contact and contact members 22 and 24 of the normally open contact.

Operating unit 14 is comprised of a zinc cast housing 32 fastened to enclosure 16, a molded plastic collar member 34, a molded plastic mushroom shaped had 36, a steel washer member 38, a steel coil spring 40, a steel spring seat 42, a rigid plastic retainer member 44, and electrically conductive metal biasing springs 46 and 48. The operating unit can also include a lamp bulb 50 for providing an illuminated push button assembly, and means for illuminating the lamp bulb which includes floating terminal members 52 and 54.

Mushroom head 36 is suitably attached to one end 56 of collar member 34 in a manner that would prevent the mushroom head from being dislodged from the collar member when the mushroom head is gripped by an operator and pulled. A hollowed out portion of the mushroom head and an adjoining hollowed out portion of the collar member forms a cavity 58 for receiving lamp 50. Collar member 34 also has a pair of recesses 60 and 62 formed within that end opposite end 56 for receiving respective base portions 64 and 66 of respective terminal members 52 and 54. Respective passageways 68 and 70 are provided within the collar member to connect respective recesses 60 and 62 to cavity 58, while allowing respective stem portions 72 and 74 of respective terminal members 52 and 54 to extend therethrough and into cavity 58 so as ultimately to make electrical contact with the appropriate portions of lamp 50 in the well known conventional manner which need not be further described.

Housing 32 has a hollow interior section 76 for receiving a portion of the collar member, wherein that end portion 78 the collar member, which is within interior section 76, is mechanically coupled to one end of an actuating plunger 80. The other end of the actuating plunger is mechanically connected to a bridge contact 82 such that when the collar member is maintained in a first position, as shown in FIG. 1, the normally closed contact comprised of contact members 18 and 20 is closed, while the normally open contact comprised of contact members 22 and 24 is opened. Similarly, when the collar member is in a second position, the plunger moves bridge contact 82 into engagement with contact members 22 and 24 so that the normally closed contact comprised of contact members 18 and 20 is open and the normally open contact comprised of contact members 22 and 24 is closed.

Switch unit 12 also has a pair of L shaped conductive members 84 and 86 fixedly positioned within enclosure 16, and electrically conductive bushings 88 and 90 attached to respective members 84 and 86. Biasing spring 46 is thus retained between bushing 88 and base member 64 of terminal member 52, while biasing spring 48 is retained between bushing 90 and base member 66 of terminal member 54. In this instance, an end of secondary winding is electrically connected to bushing 90 and the other end of the secondary winding is electrically connected to L shaped conductor member 84 so that lamp 50 wll be illuminated when the collar member is in the first position and power is supplied across the terminals of primary winding 28 of transformer 26. Thus, when mushroom head 36 is depressed and collar member 34 moves to the second position, the lamp will extinguish. Alternatively, it should be noted that the other end of secondary winding 30 could be electrically connected to contact member 24, while contact member 22 is electrically connected to conductor member 84 so that lamp 50 will be illuminated when the collar member is in the second position and power is supplied across the terminals of primary winding 28 of transformer 26. Then, when mushroom head 36 is pulled and the collar member moves to the first position, the lamp will be extinguished.

Means for maintaining collar member 34 in the first position, with the normally closed contacts closed and the normally open contacts open, is provided by means including springs 46 and 48 for biasing the collar member in the direction outward from the interior section of housing 32, a projection 92 extending from an exterior surface 94 of collar member 34, and interior section 76 of housing 32 having a portion 96 tapered inwardly toward mushroom head 36. As is shown more clearly in FIG. 2, projection 92 has an upper wall 98 and a lower wall 100 joining at an apex 102 which is distal from exterior surface 94 of collar member 34. Tapered portion 96 of housing 32 is in juxtaposition with upper wall 98 of projection 92 to limit the outward movement of collar member 34 from the interior section of the housing, whereby when upper wall 98 of projection 92 is pressed against tapered portion 96 of the interior section of housing 32, collar member 34 is maintained in the first position.

In accordance with the teachings of the invention, a detent mechanism provides a means for maintaining collar member 34 in the second position, wherein the normally closed contact is open and the normally open contact is closed. This detent mechanism includes washer member 38, spring seat 42, and spring member 40. Spring member 40 is biased toward exterior surface 94 of collar member 34 and is positioned between the planes formed by a flat surface 104 of washer member 38 and a flat surface 106 of spring seat 42, whereby the collar member is maintained in the second position when spring member 40 is squeezed between upper wall 98 of projection 92 and flat surface 104 of washer member 38.

Figure 2:
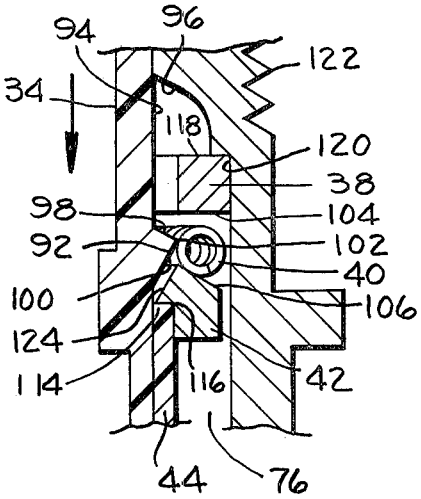
FIG. 2 is an enlarged sectional view of a detent mechanism within the push button assembly immediately before the collar member has completed its movement from the first to the second position.
Figure 3:
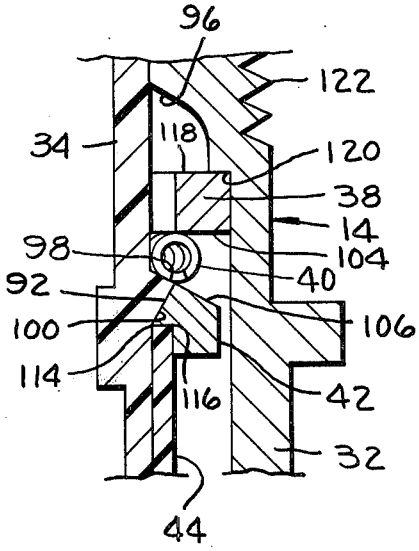
FIG. 3 is an enlarged cross sectional view of the detent mechanism shown in FIG. 2 after the collar member is in the second maintained position.
Figure 4:
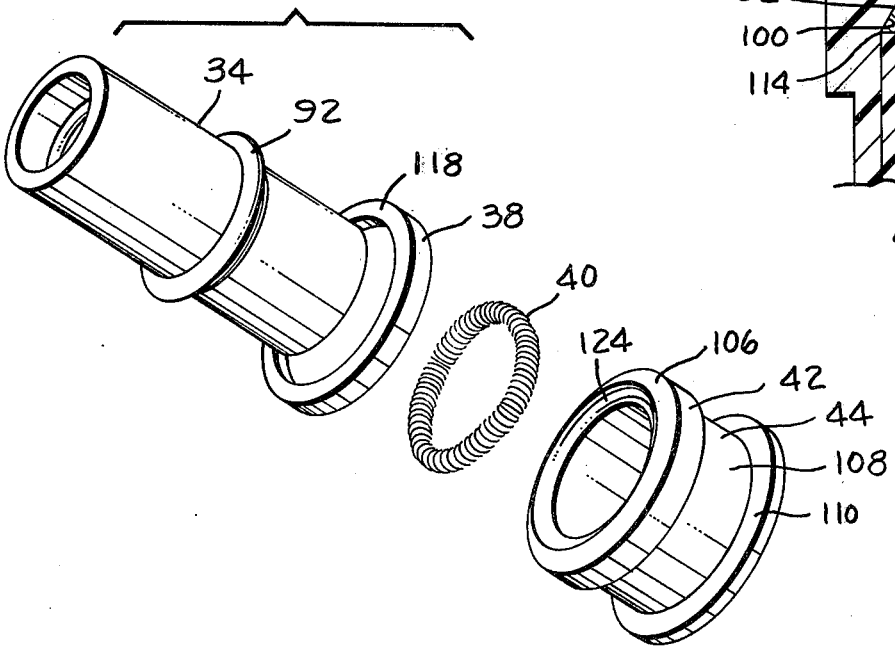
FIG. 4 is an exploded perspective view of that portion of the push button assembly which provides the detent mechanism.

As shown in FIG. 4, collar member 34 and a major portion 108 of retainer member 44 have a hollow cylindrical configuration, while projection 92, washer member 38, spring member 40, and spring seat 42 have an annular configuration and surround collar member 34. Furthermore, a flange or rim portion 110 of retainer member 44 can be staked to a lower interior corner 112 of housing 32, while, as shown in FIGS. 2 and 3, plastic retainer member 44 can have an outer lip 114 press fit into an interior corner 116 of spring seat 42, whereby to rigidly retain spring seat 42 within interior section 76 of housing 32. It should also be noted that an upper surface 118 of washer member 38 can be positioned adjacent to an upper interior corner 120 of housing 32, and upper surface 118 could be press fit or staked to interior corner 120. An upper outer surface portion 122 of housing 32 can be threaded to receive one or more bolts (not shown) for mounting push button assembly 10 onto a panel.

Spring seat 42 has a second flat surface 124 (shown in FIG. 3) which is adjoining and at approximately right angles to surface 106, and which is also approximately parallel to lower wall 100 of projection 92, whereby when collar member 34 is being maintained in the second position, lower wall 100 of projection 92 abuts flat surface 124 of spring seat 42 to limit any further movement of collar member 34 into the interior of housing 14. Also, the plane of lower wall 100 of projection 92 is approximately perpendicular to the plane of surface 106 of spring seat 42 and to the plane of upper wall 98 of the projection, while the plane of surface 104 of washer member 38 is approximately at an acute angle with the plane of upper wall 98 of the projection 92 and the plane of flat surface 106 of spring seat 42.

The operation of push button assembly 10 will now be explained. Initially, as shown in FIG. 1, and as previously explained, when collar member 34 is in the first position and the normally closed contact is closed, while the normally open contact is open, the collar member is maintained in this position by the biasing force of springs 46 and 48 which are biasing collar member 34 outward from the interior of housing 32, wherein the outward movement of the collar member is limited by upper wall 98 of projection 92 abutting the tapered interior portion 96 of housing 32. When mushroom head 36 is depressed to move collar member 34 inwardly in a direction from the first position toward the second position, lower wall 100 of projection 92 ultmately contacts spring member 40 and forces the spring member to expand outward along and in a direction parallel to surface 106 of spring seat 42 untl apex 102 of projection 92 contacts the spring member, as shown in FIG. 2. Further movement of the collar member in the same direction enables spring member 40 to contract and contact upper wall 98 of projection 92 and surface 104 of washer member 38 to retain collar member 34 in the second position, as shown in FIG. 3. To move the collar member from the second position toward the first position, it is necessary that the mushroom head be gripped and pulled so that spring member 40 is forced by upper wall 98 of projection 92 to expand outward in a direction parallel to surface 104 of washer member 38 and perpendicular to the movement of the collar member until apex 102 of projection 92 contacts the spring member. Further continued movement of the collar member in the same direction allows the biasing means to return the collar member to the first position.

Inasmuch as lower wall 100 of projection 92 applies a force to spring member 40 in a direction parallel to the expanded movement of the spring member when the collar member is moving from the first position to the second position, while the upper wall 98 of the projection 92 is applying a force to the spring member which is at approximately an acute angle to the expanded movement of the spring member when the collar member is being moved from the second to the first position, it is clear that a greater force will be required to move the collar member from the second position to the first position than is necessary to move the collar member from the first position to the second position. From this it should be clear that variations in the required degree of force necessary to move collar member 34 from the first to the second position and from the second to the first position can be accomplished by adjusting the angle of the plane of surface 106 of spring seat 42 with respect to the plane of lower wall 100 of projection 92, and the angle of the plane of surface 104 of washer member 38 with respect to the plane of upper wall 98 of projection 92.

Although the invention has been described with reference to a specific embodiment thereof, numerous modifications are possible without departing from the invention, and it is desirable to cover all modifications falling within the spirit and scope of this invention.

What we claim as new and desire to secure by Letters Patent of the United States is:

1. A push button assembly including an operating unit and a switch unit having an enclosure, said operating unit comprising:

a. a housing fastened to said switch unit enclosure and having a hollow interior section;

b. a collar member having one end positioned within said interior section of said housing and another end extending outward therefrom;

c. a mushroom head fixed to said another end of said collar member;

d. an actuating plunger having one end mechanically coupled to said one end of said collar member, and having another end coupled to said switch unit;

e. means for maintaining said collar member in a first position comprising:

i. means for biasing said collar member in the direction outward from said interior section of said housing;

ii. a projection having an upper and lower wall extending from an exterior surface of said collar member and joining at an apex distal from said exterior surface; and iii. said interior section of said housing having a portion in juxtaposition with said upper wall of said projection to limit the outward movement of said collar member, whereby when said upper wall of said projection is pressed against said portion of said interior section of said housing, said collar member is maintained in the first position; and f. means for maintaining said collar member in a second position comprising:

i. a washer member, having a flat surface positioned within said interior section of said housing;

ii. a spring seat, having a first flat surface, fixed within said interior section of said housing; and iii. a spring member biased toward said exterior surface of said collar member and positioned between the planes formed by the respective flat surfaces of said washer member and said spring seat, whereby said collar member is maintained in the second position when said spring member is squeezed between said upper wall of said projection and said flat surface of said washer member.

2. A push button assembly according to claim 1, wherein said spring seat has a second flat surface ajoining and approximately at right angles to said first flat surface.

3. A push button assembly according to claim 2, wherein when said collar member is being maintained in the second position, said lower wall of said projection abuts said second flat surface of said spring seat to limit further movement of said collar member into the interior section of said housing.

4. A push button assembly according to claim 3, wherein said washer member, said projection, said spring member, and said spring seat have an annular configuration and surround said collar member.

5. A push button assembly according to claim 4, wherein the plane of said lower wall of said projection is approximately perpendicular to the plane of said first surface of said spring seat, and the plane of said flat surface of said washer member is at approximately an acute angle with the plane of said first surface of said spring seat, whereby when said mushroom head is depressed to move said collar member in a direction from the first position toward the second position, said lower wall of said projection ultimately contacts said spring member and forces said spring member to expand outward along said first surface of said spring seat until said apex of said projection contacts said spring member, whereupon further movement of said collar member enables said spring member to contract and contact said upper wall of said projection and said flat surface of said washer member to retain said collar member in the second position, and when said mushroom head is gripped and pulled to move said collar member from the second position toward the first position, said spring member is forced by said upper wall of said projection to expand outward in a direction parallel to said flat surface of said washer member and perpendicular to movement of said collar member until said apex contacts said spring member, whereupon further continued movement of said collar member allows said biasing means to return said collar member to the first position, thereby ensuring that a greater force is required to move said collar member from the second position to the first position than is required to move said collar member from the first position to the second position.

6. A push button assembly according to claim 1 further comprising:

a. a lamp bulb positioned within said collar member;

b. means for illuminating said lamp bulb when said collar member is in either one of the first and second positions.

7. A push button assembly according to claim 1, wherein said switch unit is further comprised of at least one normally closed contact and one normally open contact positioned within said enclosure, whereby when said collar member is maintained in the first position, said normally closed contact remains closed, while said normally open contact remains open, and when said collar member is maintained in the second position, said normally closed contact is open while said normally open contact is closed.

* * * * *